US011280286B2

(12) United States Patent
Matsumoto et al.

(10) Patent No.: US 11,280,286 B2
(45) Date of Patent: Mar. 22, 2022

(54) DETECTOR

(71) Applicant: KEIHIN CORPORATION, Tokyo (JP)

(72) Inventors: Kyohei Matsumoto, Shioya-gun (JP); Daichi Kawakami, Shioya-gun (JP)

(73) Assignee: HITACHI ASTEMO, LTD., Hitachinaka (JP)

( * ) Notice: Subject to any disclaimer, the term of this patent is extended or adjusted under 35 U.S.C. 154(b) by 0 days.

(21) Appl. No.: 17/129,064

(22) Filed: Dec. 21, 2020

(65) Prior Publication Data

US 2021/0293195 A1 Sep. 23, 2021

(30) Foreign Application Priority Data

Mar. 18, 2020 (JP) ..... JP2020-047237

(51) Int. Cl.
*F02D 41/20* (2006.01)
*F02M 51/06* (2006.01)

(52) U.S. Cl.
CPC ..... *F02D 41/20* (2013.01); *F02D 2041/2013* (2013.01); *F02D 2041/2055* (2013.01); *F02M 51/061* (2013.01)

(58) Field of Classification Search
CPC ..... F02D 41/20; F02D 2041/2013; F02D 2041/2055; F02M 51/061
See application file for complete search history.

(56) References Cited

U.S. PATENT DOCUMENTS

2019/0360424 A1* 11/2019 Parotto ..... F02D 41/20

FOREIGN PATENT DOCUMENTS

JP 2015172346 A * 10/2015
JP 2016180345 A 10/2016

OTHER PUBLICATIONS

Aono, JP 2015-172346, machine translation. (Year: 2015).*

* cited by examiner

*Primary Examiner* — Hung Q Nguyen
*Assistant Examiner* — Mark L. Greene
(74) *Attorney, Agent, or Firm* — Cantor Colburn LLP

(57) ABSTRACT

This detector includes: a filtering unit performing a first filtering process of performing a filtering process on a first waveform or a second filtering process of performing a filtering process on a second waveform; a detection unit detecting a timing of a first peak value corresponding to a predetermined peak value of a third waveform; a correction unit which corrects a deviation of a detection value corresponding to a timing detected by the detection unit with respect to a timing when the fuel injection valve is actually opened or closed based on a difference between the first peak value of the third waveform and a second peak value of the third waveform appearing after the first peak value; and a detecting unit which detects one or both of the opening and closing of the fuel injection valve based on the detection value corrected by the correction unit.

8 Claims, 4 Drawing Sheets

DETECTOR

CROSS REFERENCE TO RELATED APPLICATIONS

The present invention claims priority under 35 U.S.C. § 119 to Japanese Patent Application No. 2020-047237, filed on Mar. 18, 2020, the entire content of which is incorporated herein by reference.

BACKGROUND OF THE INVENTION

Field of the Invention

The present invention relates to a detector.

Description of Related Art

Japanese Unexamined Patent Application No. 2016-180345 discloses a control device that controls a fuel injection valve having a solenoid coil.

This control device differentiates a voltage waveform generated in the solenoid coil by energization, and detects a timing of a peak of a differential waveform which is the differentiated voltage waveform as a timing when the fuel injection valve is closed or opened.

The voltage waveform contains noise. Thus, the electromagnetic valve drive device uses a low-pass filter to remove noise contained in the voltage waveform or the differential waveform.

SUMMARY OF THE INVENTION

When the low-pass filter is applied to the voltage waveform or the differential waveform, the differential waveform becomes blunt. Thus, for example, the peak of the differential waveform of the voltage waveform before the noise is removed by the low-pass filter and the peak of the differential waveform of the voltage waveform after the noise is removed by the low-pass filter are deviated from each other. This deviation of the peak is one of the factors that deteriorate the accuracy of detecting whether or not the fuel injection valve is opened or closed.

The present invention has been made in view of such circumstances and an object of the present invention is to provide a detector that improves an accuracy of detecting whether or not a fuel injection valve is opened or closed.

(1) According to an aspect of the present invention, there is provided a detector that detects one or both of the opening and closing of a fuel injection valve having a solenoid coil, including: a filtering unit which performs a first filtering process of performing a filtering process on a first waveform or a second filtering process of performing a filtering process on a second waveform corresponding to a differential waveform of the first waveform, the first waveform corresponding to a first voltage waveform generated in the solenoid coil or a second voltage waveform obtained based on the first voltage waveform; a detection unit which detects a timing of a first peak value corresponding to a predetermined peak value of a third waveform when the differential waveform of the first waveform or the second waveform is the third waveform; a correction unit which corrects a deviation of a detection value corresponding to a timing detected by the detection unit with respect to a timing when the fuel injection valve is actually opened or closed based on a difference between the first peak value of the third waveform and a second peak value of the third waveform appearing after the first peak value; and a detecting unit which detects one or both of the opening and closing of the fuel injection valve based on the detection value corrected by the correction unit.

(2) In the detector of the above (1), the correction unit may correct the deviation based on the difference between the first peak value corresponding to an upward peak value of the third waveform and the second peak value corresponding to a downward peak value first appearing after the first peak value in the third waveform.

(3) In the detector of the above (1) or (2), the correction unit may correct the detection value based on the difference so that the detection value corresponding to the timing detected by the detection unit matches the timing when the fuel injection valve is actually opened or closed.

(4) In the detector of any one of the above (1) to (3), the filtering unit may be a finite impulse response filter.

As described above, according to the above-described aspect of the present invention, it is possible to improve the accuracy of detecting whether or not the fuel injection valve is opened or closed.

DETAILED DESCRIPTION OF THE INVENTION

Hereinafter, an electromagnetic valve drive device according to an embodiment of the present invention will be described with reference to the drawings.

Figure 1:
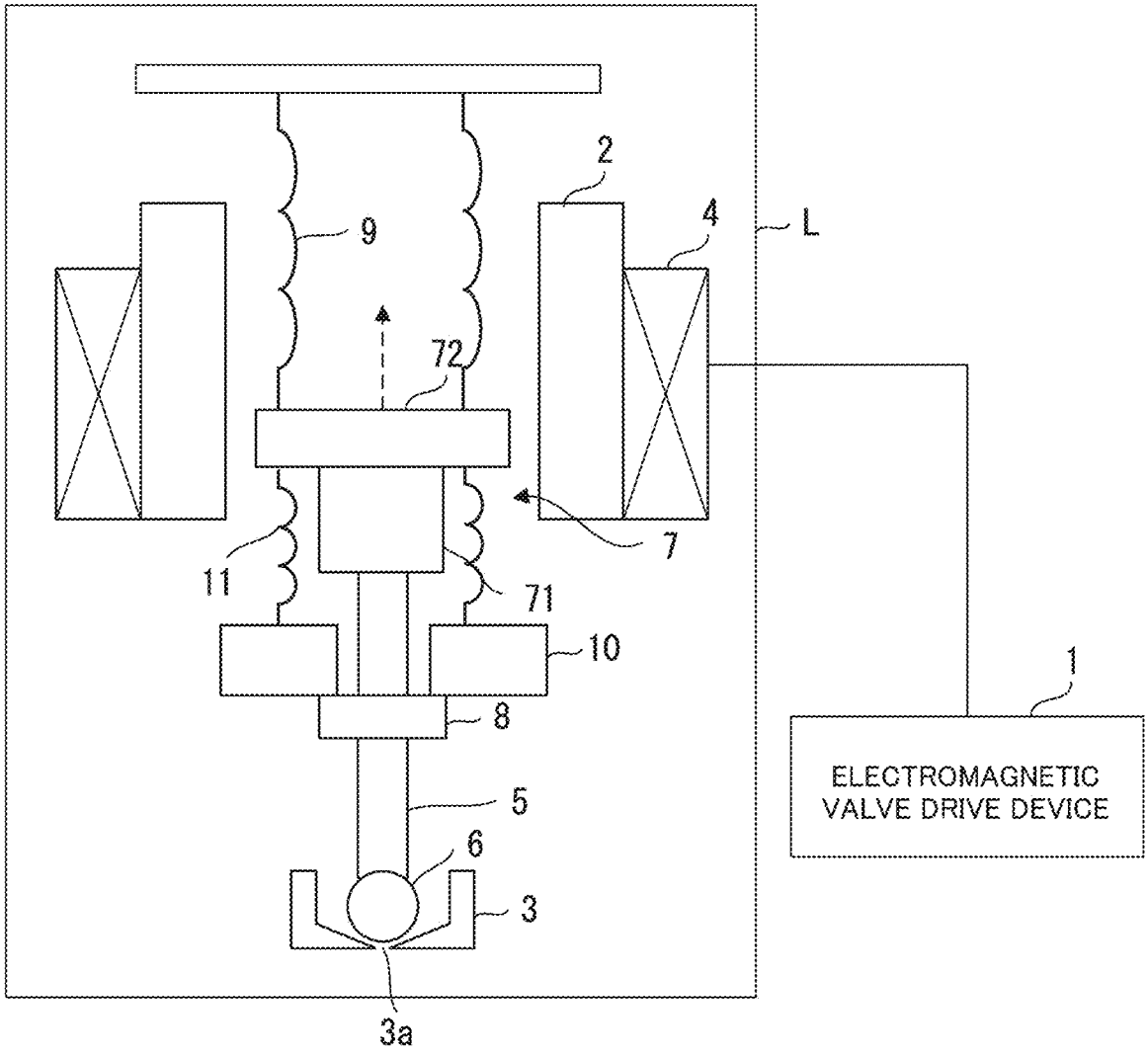
FIG. 1 is a diagram showing a configuration example of a fuel injection valve L according to an embodiment of the present invention.

As shown in FIG. 1, an electromagnetic valve drive device 1 according to the present embodiment is a drive device that drives a fuel injection valve L. Specifically, the electromagnetic valve drive device 1 according to the present embodiment is an electromagnetic valve drive device that drives the fuel injection valve L (solenoid valve) injecting a fuel into an internal combustion engine mounted on a vehicle.

The fuel injection valve L is an electromagnetic valve (solenoid valve) that injects a fuel into an internal combustion engine such as a gasoline engine or a diesel engine mounted on a vehicle.

Hereinafter, the configuration example of the fuel injection valve L will be described with reference to FIG. 1.

As shown in FIG. 1, the fuel injection valve L includes a fixed core 2, a valve seat 3, a solenoid coil 4, a needle 5, a valve body 6, a retainer 7, a lower stopper 8, a valve body urging spring 9, a movable core 10, and a movable core urging spring 11. In the present embodiment, the fixed core 2, the valve seat 3, and the solenoid coil 4 are fixed members; and the needle 5, the valve body 6, the retainer 7, the lower stopper 8, the valve body urging spring 9, the movable core 10, and the movable core urging spring 11 are movable members.

The fixed core 2 is a cylindrical member and is fixed to a housing (not shown) of the fuel injection valve L. The fixed core 2 is made of a magnetic material.

The valve seat 3 is fixed to the housing of the fuel injection valve L. The valve seat 3 includes an injection hole 3*a*.

The injection hole 3*a* is a hole for injecting a fuel, is closed when the valve body 6 sits on the valve seat 3, and is opened when the valve body 6 is separated from the valve seat 3.

The solenoid coil 4 is formed by winding an electric wire in an annular shape. The solenoid coil 4 is disposed concentrically with the fixed core 2.

The solenoid coil 4 is electrically connected to the electromagnetic valve drive device 1. The solenoid coil 4 is energized from the electromagnetic valve drive device 1 to form a magnetic path including the fixed core 2 and the movable core 10.

The needle 5 is an elongated rod member that extends along the center axis of the fixed core 2. The needle 5 moves in the axial direction of the center axis of the fixed core 2 (the extension direction of the needle 5) by the attractive force generated by the magnetic path including the fixed core 2 and the movable core 10. Additionally, in the description below, in the axial direction of the center axis of the fixed core 2, a direction in which the movable core 10 moves due to the attractive force will be referred to as an upward direction and a direction which is on the side opposite to the movement direction of the movable core 10 due to the attractive force will be referred to as a downward direction.

The valve body 6 is formed at the lower tip of the needle 5. The valve body 6 sits on the valve seat 3 to close the injection hole 3*a* and is separated from the valve seat 3 to open the injection hole 3*a*.

The retainer 7 includes a guide member 71 and a flange 72.

The guide member 71 is a cylindrical member that is fixed to an upper end of the needle 5.

The flange 72 is formed at an upper end of the guide member 71 to protrude in the radial direction of the needle 5.

A lower end surface of the flange 72 is a contact surface with respect to the movable core urging spring 11. Further, an upper end surface of the flange 72 is a contact surface with respect to the valve body urging spring 9.

The lower stopper 8 is a cylindrical member that is fixed to the needle 5 between the valve seat 3 and the guide member 71. An upper end surface of the lower stopper 8 is a contact surface with respect to the movable core 10.

The valve body urging spring 9 is a compression coil spring which is received in the fixed core 2 and is inserted between an inner wall surface of the housing and the flange 72. The valve body urging spring 9 urges the valve body 6 downward. That is, when the solenoid coil 4 is not energized, the valve body 6 is brought into contact with the valve seat 3 by the urging force of the valve body urging spring 9.

The movable core 10 is disposed between the guide member 71 and the lower stopper 8. The movable core 10 is a cylindrical member and is provided coaxially with the needle 5. This movable core 10 is formed such that a through-hole is formed at the center so that the needle 5 is inserted therethrough and is movable along the extension direction of the needle 5.

An upper end surface of the movable core 10 is a contact surface with respect to the fixed core 2 and the movable core urging spring 11. On the other hand, a lower end surface of the movable core 10 is a contact surface with respect to the lower stopper 8. The movable core 10 is made of a magnetic material.

The movable core urging spring 11 is a compression coil spring which is inserted between the flange 72 and the movable core 10. The movable core urging spring 11 urges the movable core 10 downward. That is, the movable core 10 is brought into contact with the lower stopper 8 by the urging force of the movable core urging spring 11 when the solenoid coil 4 is not energized.

Next, the electromagnetic valve drive device 1 according to the present embodiment will be described.

Figure 2:
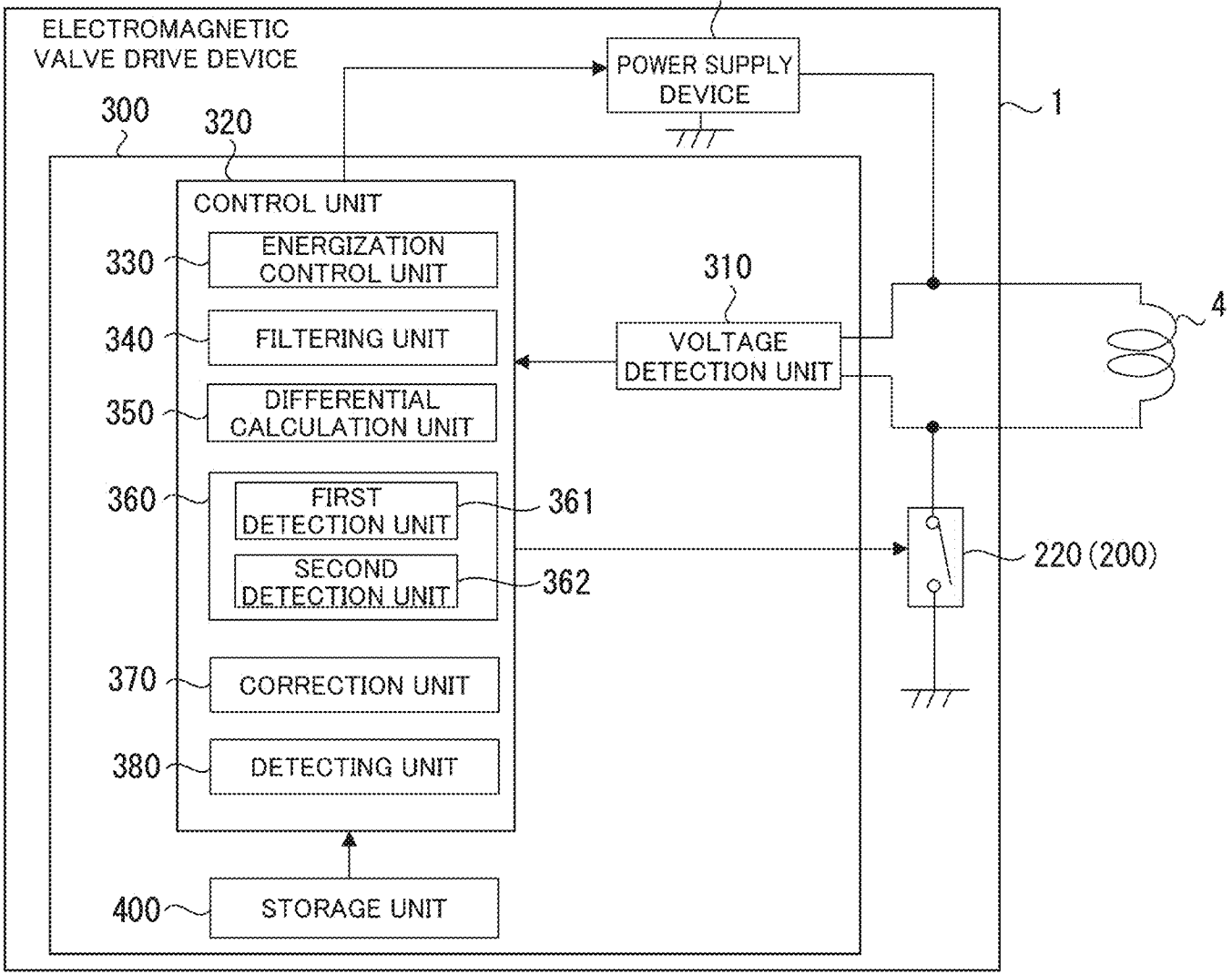
FIG. 2 is a diagram showing a configuration example of an electromagnetic valve drive device 1 according to the same embodiment.

As shown in FIG. 2, the electromagnetic valve drive device 1 includes a drive device 200 and a control device 300.

The drive device 200 includes a power supply device 210 and a switch 220.

The power supply device 210 includes at least one of a battery and a booster circuit. The battery is mounted on the vehicle. The booster circuit boosts a battery voltage Vb which is an output voltage of the battery and outputs a boosted voltage Vs which is the boosted voltage. The power supply device 210 may output the battery voltage Vb to the solenoid coil 4.

The power supply device 210 outputs the boosted voltage Vs to the solenoid coil 4 so that the voltage flows through the solenoid coil 4. The power supply device 210 may output the battery voltage Vb to the solenoid coil 4 so that the voltage flows through the solenoid coil 4. The voltage output from the power supply device 210 to the solenoid coil 4 is controlled by the control device 300. Further, the energization of the solenoid coil 4 is controlled by the control device 300.

The switch 220 is controlled in an on state or an off state by the control device 300. When the switch 220 is controlled in an on state, the voltage output from the power supply device 210 is supplied to the solenoid coil 4. Accordingly, the energization of the solenoid coil 4 is started. When the switch 220 is controlled in an off state, the supply of the voltage from the power supply device 210 to the solenoid coil 4 is stopped.

The control device 300 includes a voltage detection unit 310, a control unit 320, and a storage unit 400. In addition, the control device 300 is an example of the "detector" of the present invention.

The voltage detection unit 310 detects a voltage Vc generated in the solenoid coil 4. For example, the voltage Vc is the voltage across both ends of the solenoid coil 4. The voltage detection unit 310 outputs the detected voltage Vc to the control unit 320.

The control unit 320 includes an energization control unit 330, a filtering unit 340, a differential calculation unit 350, a detection unit 360, a correction unit 370, and a detecting unit 380.

The energization control unit 330 controls the power supply device 210. The energization control unit 330 controls the switch 220 in an on state or an off state. The energization control unit 330 controls the switch 220 in an on state so that the voltage is supplied from the power supply device 210 to the solenoid coil 4. The energization control unit 330 controls the switch 220 from an on state to an off state so that the supply of the voltage from the power supply device 210 to the solenoid coil 4 is stopped. When the supply of the voltage to the solenoid coil 4 is stopped, a counter electromotive force is generated in the solenoid L and a counter electromotive voltage is generated across both ends of the solenoid L. This counter electromotive voltage decreases with time and disappears after a certain period of time. The valve body 6 of the opened fuel injection valve L collides with the valve seat 3 so that the valve is closed until such a voltage difference disappears and a decreasing gradient of the voltage difference changes when the valve body 6 collides with the valve seat 3. The control unit 320 of the present embodiment detects the closing of the fuel injection valve L by detecting the change in the decreasing gradient.

The filtering unit 340 generates a filter waveform Wf by performing a filtering process on a waveform (hereinafter, referred to as a "voltage waveform") Wv of the voltage Vc output from the voltage detection unit 310. This voltage Vc is the voltage Vc after the switch 220 is controlled from an on state to an off state. The filtering process is a process for removing a noise component included in the voltage waveform Wv of the voltage Vc. For example, the filtering unit 340 is a low-pass filter. For example, the filtering unit 340 is a finite impulse response (FIR) filter. The filtering unit 340 outputs the generated filter waveform Wf to the differential calculation unit 350. Additionally, the voltage waveform Wv is an example of the "first waveform" of the present invention.

The differential calculation unit 350 generates a differential waveform Wd by time-differentiating the filter waveform Wf generated by the filtering unit 340. The differential calculation unit 350 outputs the generated differential waveform Wd to the correction unit 370. Additionally, the differential waveform Wd of the present embodiment is a first-order differential of the voltage waveform Wv, but is not limited only to the first-order differential. The differential waveform may be a higher-order differential which is equal to or higher than the second-order differential. The differential waveform Wd is an example of the "third waveform" of the present invention.

The detection unit 360 includes a first detection unit 361 and a second detection unit 362.

The first detection unit 361 detects a first peak value which is a predetermined peak value of the differential waveform Wd and a timing Tp of the first peak value. In the present embodiment, the first peak value is the differential value of the upward peak in the differential waveform Wd. For example, the detection unit 360 detects the differential value of the upward peak (hereinafter, referred to as a "first peak") P1 appearing first in the differential waveform Wd as the first peak value. For example, the timing Tp of the first peak value is the time when the first detection unit 361 detects the first peak value. As an example, the first detection unit 361 detects the time from the stop of the energization of the solenoid coil 4 to the first peak as the timing Tp.

The second detection unit 362 detects a second peak value appearing after the first peak value in the differential waveform Wd. In the present embodiment, the second peak value is the differential value of the downward peak in the differential waveform Wd. For example, the detection unit 360 detects the differential value of the downward peak appearing first after the first peak value in the differential waveform Wd as the second peak value.

The correction unit 370 corrects a deviation ΔToffset from the timing when the actual fuel injection valve L is closed in the detection value of the first detection unit 361 (the timing Tp) based on a difference ΔY between the first peak value of the differential waveform Wd and the second peak value of the differential waveform Wd appearing after the first peak value. For example, the correction unit 370 corrects the deviation ΔToffset based on the difference ΔY between the first peak value and the second peak value detected by the detection unit 360.

As an example, the correction unit 370 acquires the difference ΔY by calculating a difference between the first peak value detected by the first detection unit 361 and the second peak value detected by the second detection unit 362. The correction unit 370 corrects the detection value of the first detection unit 361 (the timing Tp) so that the deviation ΔToffset disappears based on the difference ΔY. For example, the correction unit 370 reads the deviation ΔToffset corresponding to the difference ΔY from information X stored in the storage unit 400. Then, the correction unit 370 corrects the detection value by adding the read deviation ΔToffset to the detection value of the first detection unit 361. The correction unit 370 outputs the corrected detection value (hereinafter, referred to as a "correction value") to the detecting unit 380. Accordingly, the correction value is the timing when the actual fuel injection valve L is closed.

The detecting unit 380 detects the closing of the fuel injection valve L based on the correction value. In the present embodiment, the detecting unit 380 detects the closing of the fuel injection valve L at the time indicated by the correction value.

The storage unit 400 stores the information X. The information X is the information in which the difference ΔY is correlated with the deviation ΔToffset. The present inventors have found that there is a correlation between the difference ΔY and the deviation ΔToffset. When the difference ΔY increases, the deviation ΔToffset also increases in this way. On the other hand, when the difference ΔY decreases, the deviation ΔToffset also decreases in this way. For example, the deviation ΔToffset is represented by a function having the difference ΔY as a variable.

The difference ΔY between the first peak value and the second peak value of the differential waveform Wd changes according to the filtering characteristics. The timing when the fuel injection valve L is actually closed is when the upward peak of the differential waveform Wx of the voltage waveform Wv not subjected to the filtering process occurs. Similarly, the temporal deviation ΔToffset generated between the upward peak of the differential waveform Wx and the upward peak (the first peak) of the differential waveform Wd also changes according to the filtering characteristics. That is, the difference ΔY and the deviation ΔToffset show the same filtering characteristics and have a correlation.

This information X is information such as a mathematical formula or a table in which the difference ΔY and the deviation ΔToffset are correlated with each other.

Hereinafter, the action and effect of the present embodiment will be described.

The control unit 320 starts the energization of the solenoid coil 4 at a predetermined energization start time. Then, the control unit 320 stops the energization of the solenoid coil 4 at an energization stop time which is a time after a predetermined time elapses from the energization start time. When the energization of the solenoid coil 4 is stopped, a counter electromotive voltage is generated across both ends of the solenoid coil 4. This counter electromotive voltage decreases with time and disappears after a predetermined time elapses. Until such a voltage difference disappears, the valve body 6 of the fuel injection valve L collides with the valve seat 3 so that the fuel injection valve L is closed. When the fuel injection valve L is closed, the inductance in the magnetic path formed in the fuel injection valve L changes. This inductance change changes the voltage Vc which is the voltage difference.

Here, the control unit 320 can detect the closing of the fuel injection valve L by detecting the peak of the differential waveform Wx which is the waveform obtained by differentiating the voltage waveform Wv of the voltage Vc. Here, the differential waveform Wx contains noise of high-frequency components. Here, the control unit 320 removes noise of high-frequency components contained in the voltage waveform Wv by applying a low-pass filter such as a FIR filter to the voltage waveform Wv. Then, the control unit 320 generates the differential waveform Wd from which noise is removed by differentiating the voltage waveform (the filter waveform Wf) from which noise of high-frequency components is removed.

Figure 3:
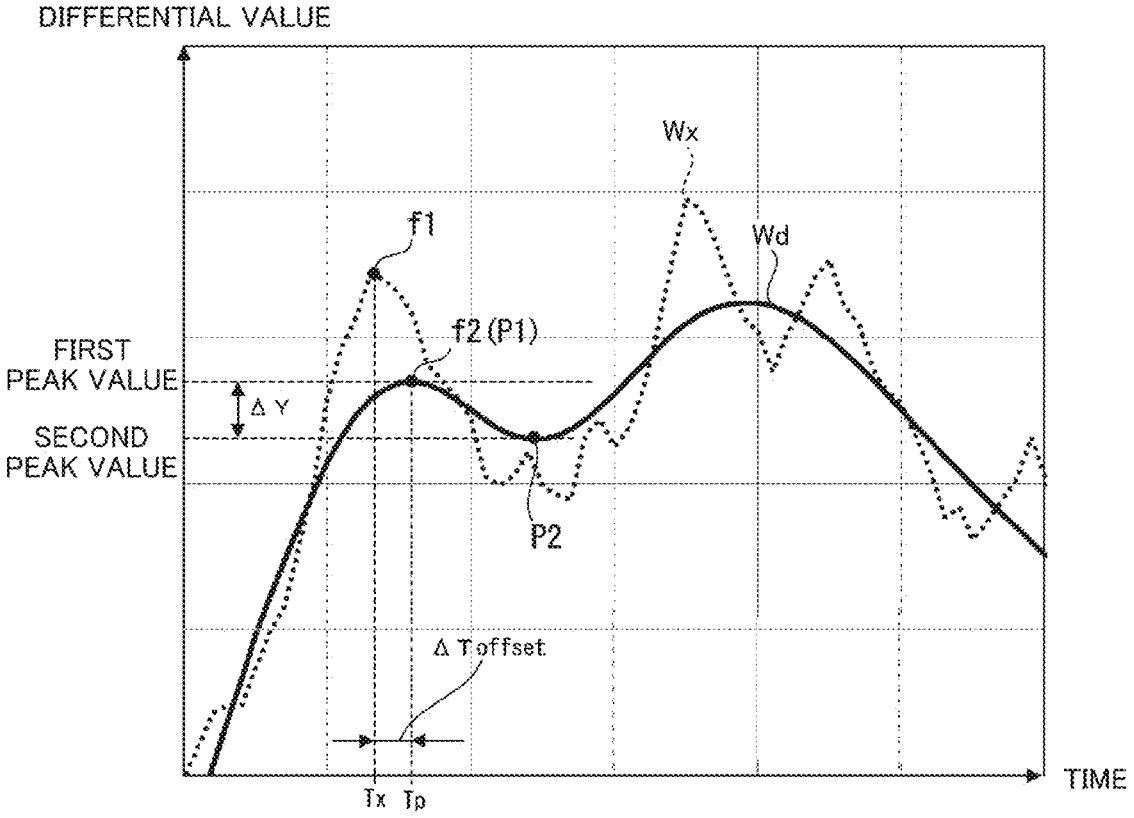
FIG. 3 is a diagram illustrating a method of correcting a deviation ΔToffset according to the same embodiment.

However, as shown in FIG. 3, the peak f2 (P1) of the differential waveform Wd has the temporal deviation ΔToffset with respect to the peak f1 of the differential waveform Wx. Here, the timing Tx showing the peak of the differential waveform Wx is the timing when the fuel injection valve L is closed. Thus, when the timing Tp showing the peak of the differential waveform Wd is detected as the closing timing of the fuel injection valve L, the detection value includes the deviation ΔToffset from the timing when the actual fuel injection valve L is closed.

Here, the control unit 320 corrects the deviation ΔToffset included in the detection value based on the difference ΔY by using the correlation between the deviation ΔToffset and the difference ΔY which is a difference between the first peak value and the second peak value of the differential waveform Wd. Specifically, the control unit 320 detects a downward peak of the differential waveform Wd and corrects the detection value (the timing Tp) based on the difference ΔY so that the deviation ΔToffset disappears. Accordingly, the control unit 320 can improve the accuracy of detecting the closing of the fuel injection valve L.

Although one embodiment of the present invention has been described in detail with reference to the drawings, the specific configuration is not limited to only the above embodiment, and may include a design within a range that does not deviate from the gist of the present invention.

The filtering unit 340 generates the filter waveform Wf by performing a filtering process on the voltage waveform Wv (the first voltage waveform). However, the filtering unit 340 may generate the filter waveform Wf by performing the filtering process on the voltage waveform (the second voltage waveform) obtained based on the voltage waveform Wv instead of the voltage waveform Wv detected by the voltage detection unit 310. The voltage waveform obtained based on the voltage waveform Wv is not the voltage waveform Wv itself detected by the voltage detection unit 310, but may be a voltage waveform obtained by performing a predetermined process on the voltage waveform Wv. This predetermined process is not particularly limited.

For example, the voltage waveform obtained based on the voltage waveform Wv may be a difference waveform which is a difference between a normal operation waveform which is the voltage waveform of the fuel injection valve when the fuel injection valve is operated and a non-operation waveform which is the voltage waveform of the fuel injection valve when the fuel injection valve is not operated described in Japanese Unexamined Patent Application, First Publication No. 2016-180345.

The detecting unit 380 of the above-described embodiment detects the closing of the fuel injection valve L based on the correction value. However, the present invention is not limited thereto and the detecting unit 380 may detect the opening of the fuel injection valve L based on the correction value. In this case, the deviation ΔToffset indicates the deviation between the timing of the first peak value detected by the first detection unit 361 and the timing when the actual fuel injection valve L is opened. That is, the correction unit 370 corrects the deviation ΔToffset from the timing when the actual fuel injection valve L is opened in the detection value which is the timing detected by the first detection unit 361 based on the difference ΔY between the first peak value of the differential waveform Wd and the second peak value of the differential waveform Wd appearing after the first peak value.

Figure 4A:
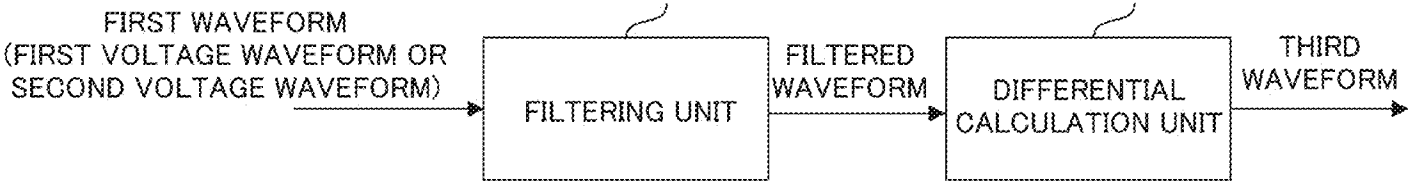
FIG. 4A is a diagram illustrating a method of generating a third waveform according to the same embodiment.
Figure 4B:
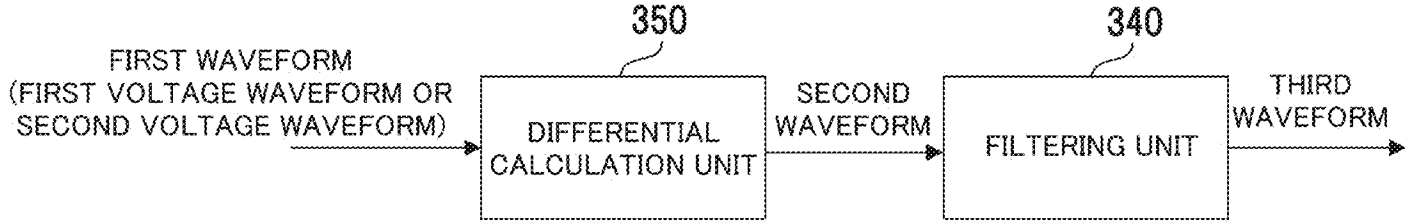
FIG. 4B is a diagram illustrating a method of generating the third waveform according to the same embodiment.

The differential calculation unit 350 of the above-described embodiment differentiates the filter waveform Wf which is the voltage waveform subjected to the filtering process by the filtering unit 340 as shown in FIG. 4A, but the present invention is not limited thereto. As shown in FIG. 4B, the voltage waveform input to the filtering unit 340 may be differentiated. That is, the differential calculation unit 350 may differentiate any one waveform (the first waveform) of the first voltage waveform and the second voltage waveform (FIG. 4B). In this case, the filtering unit 340 performs a filtering process on the differential waveform (the second waveform) of the first voltage waveform or the second voltage waveform and outputs the differential waveform subjected to the filtering process to the correction unit 370 (FIG. 4B). Thus, the filtering unit 340 performs any one filtering process of: the first filtering process for performing the filtering process on the first waveform which is any one voltage waveform of the first voltage waveform and the second voltage waveform (FIG. 4A); and the second filtering process for performing the filtering process on the second waveform which is the differential waveform of the first waveform (FIG. 4B).

The detection unit 360 detects the timing of the first peak value which is a predetermined peak value of the third waveform corresponding to any one waveform of the differential waveform of the first waveform subjected to the first filtering process and the second waveform subjected to the second filtering process. The correction unit 370 corrects the deviation from the timing when the actual fuel injection valve is opened or closed in the detection value which is the timing detected by the detection unit based on the difference between the first peak value of the third waveform and the second peak value of the third waveform appearing after the first peak value.

The control unit 320 of the present embodiment delays or advances the detection value which is the timing detected by the first detection unit 361 by a time (the deviation ΔToffset) corresponding to the difference ΔY. Accordingly, the control unit 320 detects the time in which the detection value is delayed or advanced by the deviation ΔToffset as the valve opening timing or the valve closing timing. Thus, the control unit 320 can improve the accuracy of detecting at least one of the closing and opening of the fuel injection valve L.

The filtering unit 340 may be a FIR filter. The FIR filter has a characteristic that phase distortion is unlikely to occur. Thus, the control unit 320 can further improve the accuracy of detecting at least one of the closing and opening of the fuel injection valve L by using the FIR filter as the filtering unit 340.

Additionally, a part or all of the control unit 320 may be realized by a computer. In this case, the computer may include a processor such as a CPU and GPU and a computer-readable recording medium. Then, a program for realizing a part or all of the control unit 320 by a computer may be stored in the computer-readable recording medium and the program recorded in the recording medium is read by the processor to be executed. Here, the "computer-readable recording medium" refers to a portable medium such as a flexible disk, a magneto-optical disk, a ROM, or a CD- ROM, or a storage device such as a hard disk built in a computer system. Furthermore, examples of the "computer-readable recording medium" may include a medium that dynamically holds a program for a short period of time, such as a communication line when a program is transmitted via a network such as an internet or a communication line such as a telephone line and a medium that holds a program for a predetermined time, such as a volatile memory inside a computer system that is a server or a client in that case. Further, the above-described program may be for realizing a part of the above-described functions, may be for realizing the above-described function in combination with the program already recorded in the computer system, or may be realized by using a programmable logic device such as FPGA.

EXPLANATION OF REFERENCES

1 Electromagnetic valve drive device
4 Solenoid coil
300 Control device (detector)
340 Filtering unit
350 Differential calculation unit
360 Detection unit
370 Correction unit
380 Detecting unit
L Fuel injection valve

What is claimed is:

1. A detector that detects one or both of an opening and a closing of a fuel injection valve having a solenoid coil, comprising:

a filtering unit which performs a first filtering process of performing a filtering process on a first waveform or a second filtering process of performing a filtering process on a second waveform corresponding to a differential waveform of the first waveform, the first waveform corresponding to a first voltage waveform generated in the solenoid coil or a second voltage waveform obtained based on the first voltage waveform;

a detection unit which detects a timing of a first peak value corresponding to a predetermined peak value of a third waveform when the differential waveform of the first waveform or the second waveform is the third waveform;

a correction unit which corrects a deviation of a detection value corresponding to the timing detected by the detection unit with respect to a timing when the fuel injection valve is actually opened or closed based on a difference between the first peak value of the third waveform and a second peak value of the third waveform appearing after the first peak value; and a detecting unit which detects one or both of the opening and the closing of the fuel injection valve based on the detection value corrected by the correction unit.

2. The detector according to claim 1, wherein the correction unit corrects the deviation based on the difference between the first peak value corresponding to an upward peak value of the third waveform and the second peak value corresponding to a downward peak value first appearing after the first peak value in the third waveform.

3. The detector according to claim 2, wherein the correction unit corrects the detection value based on the difference so that the detection value corresponding to the timing detected by the detection unit matches the timing when the fuel injection valve is actually opened or closed.

4. The detector according to claim 3, wherein the filtering unit is a finite impulse response filter.

5. The detector according to claim 2, wherein the filtering unit is a finite impulse response filter.

6. The detector according to claim 1, wherein the correction unit corrects the detection value based on the difference so that the detection value corresponding to the timing detected by the detection unit matches the timing when the fuel injection valve is actually opened or closed.

7. The detector according to claim 6, wherein the filtering unit is a finite impulse response filter.

8. The detector according to claim 1, wherein the filtering unit is a finite impulse response filter.

* * * * *